US009353569B1

(12) United States Patent
Anderson, Jr. et al.

(10) Patent No.: US 9,353,569 B1
(45) Date of Patent: May 31, 2016

(54) CONNECTORS FOR A FLOOD VENT

(71) Applicant: Smart Vent Products, Inc., Pitman, NJ (US)

(72) Inventors: Winfield Scott Anderson, Jr., Palm Beach Gardens, FL (US); Tom Little, Pitman, NJ (US); Michael J. Graham, Pitman, NJ (US)

(73) Assignee: Smart Vent Products, Inc., Pitman, NJ (US)

( * ) Notice: Subject to any disclaimer, the term of this patent is extended or adjusted under 35 U.S.C. 154(b) by 0 days.

(21) Appl. No.: 14/681,236

(22) Filed: Apr. 8, 2015

(51) Int. Cl.

| | |
|---|---|
| ***E06B 11/00*** | (2006.01) |
| ***E06B 9/00*** | (2006.01) |
| ***E06B 5/10*** | (2006.01) |
| ***E04H 9/14*** | (2006.01) |

(52) U.S. Cl.
CPC *E06B 9/00* (2013.01); *E04H 9/145* (2013.01); *E06B 5/10* (2013.01); *E06B 2009/007* (2013.01)

(58) Field of Classification Search
CPC ..... E06B 9/00; E06B 5/10; E06B 2009/007; E04H 9/145; Y10T 25/304; Y10T 25/306; Y10T 25/307; Y10T 25/44017; Y10T 25/45251
USPC ..... 49/10, 463, 506
See application file for complete search history.

(56) References Cited

U.S. PATENT DOCUMENTS

| | | | |
|---|---|---|---|
| 73,159 | A | 1/1868 | Besse |
| 100,623 | A | 3/1870 | Hays |
| 314,865 | A | 3/1885 | Monger |
| 735,053 | A | 8/1903 | Bates |
| 850,441 | A | 4/1907 | McGinnis |
| 911,290 | A | 2/1909 | Burkett |
| 1,089,232 | A | 3/1914 | Larson |
| 2,105,735 | A | 1/1938 | Hodge |
| 2,118,535 | A | 5/1938 | Betts |
| 2,565,122 | A | 8/1951 | Cowan |
| 2,611,310 | A | 9/1952 | Cowan |
| 2,774,116 | A | 12/1956 | Wolverton |
| 2,798,422 | A | 7/1957 | Bourque |

(Continued)

FOREIGN PATENT DOCUMENTS

| | | |
|---|---|---|
| EP | 2662513 | 11/2013 |
| EP | 2682687 | 1/2014 |

(Continued)

OTHER PUBLICATIONS

Smart Vent, web pages from www.smartvent.com, printed Apr. 6, 2015.

(Continued)

*Primary Examiner* — Jerry Redman
(74) *Attorney, Agent, or Firm* — Akerman LLP

(57) ABSTRACT

According to one embodiment, a flood vent includes a frame, a door, and at least one connector. The frame forms a fluid passageway through an opening in a structure. Furthermore, the frame extends into the opening in the structure in a first direction. The door is pivotally mounted to the frame in the fluid passageway, and allows a fluid to flow through the fluid passageway. The at least one connector is positioned between an outer perimeter of the frame and an inner perimeter of the opening. Furthermore, each of the at least one connector is configured to apply pressure to the inner perimeter of the opening in a second direction that is at least generally orthogonal to the first direction.

13 Claims, 4 Drawing Sheets

(56) References Cited

U.S. PATENT DOCUMENTS

| | | | | | |
|---|---|---|---|---|---|
| 3,123,867 | A | | 3/1964 | Combs | |
| 3,425,175 | A | | 2/1969 | Gerde | |
| 3,680,329 | A | | 8/1972 | Burtis | |
| 3,683,630 | A | | 8/1972 | Alexandre | |
| 3,927,709 | A | | 12/1975 | Anderson et al. | |
| 3,939,863 | A | | 2/1976 | Robison | |
| 3,942,328 | A | | 3/1976 | Bunger | |
| 3,974,654 | A | | 8/1976 | Mirto et al. | |
| 3,978,616 | A | | 9/1976 | Pennock | |
| 4,048,771 | A | | 9/1977 | Thistlethwaite | |
| 4,116,213 | A | | 9/1978 | Kamezaki | |
| 4,146,346 | A | | 3/1979 | Salo | |
| 4,174,913 | A | | 11/1979 | Schliesser | |
| 4,227,266 | A | | 10/1980 | Russell | |
| 4,231,412 | A | | 11/1980 | Nowak | |
| 4,290,635 | A | | 9/1981 | McKenzie | |
| 4,349,296 | A | | 9/1982 | Langeman | |
| 4,378,043 | A | | 3/1983 | Sorenson | |
| 4,549,837 | A | | 10/1985 | Herbert | |
| 4,576,512 | A | | 3/1986 | Combes et al. | |
| 4,606,672 | A | | 8/1986 | LeSire | |
| 4,669,371 | A | * | 6/1987 | Sarazen et al. | 454/276 |
| 4,676,145 | A | | 6/1987 | Allred | |
| 4,699,045 | A | | 10/1987 | Hensley | |
| 4,754,696 | A | * | 7/1988 | Sarazen et al. | 454/256 |
| 5,171,102 | A | | 12/1992 | De Wit | |
| 5,253,804 | A | | 10/1993 | Sarazen et al. | |
| 5,293,920 | A | | 3/1994 | Vagedes | |
| 5,294,049 | A | | 3/1994 | Trunkle et al. | |
| 5,330,386 | A | | 7/1994 | Calandra | |
| 5,408,789 | A | | 4/1995 | Plfeger | |
| 5,460,572 | A | | 10/1995 | Waltz et al. | |
| 5,487,701 | A | * | 1/1996 | Schedegger et al. | 454/271 |
| 5,904,199 | A | | 5/1999 | Messner | |
| 6,012,260 | A | * | 1/2000 | Hendrick et al. | 52/302.1 |
| 6,092,580 | A | | 7/2000 | Lucas | |
| 6,287,050 | B1 | | 9/2001 | Montgomery et al. | |
| 6,485,231 | B2 | | 11/2002 | Montgomery et al. | |
| 6,875,102 | B2 | * | 4/2005 | Achen | 454/283 |
| 7,128,643 | B2 | * | 10/2006 | Beliveau et al. | 454/276 |
| 8,308,396 | B2 | * | 11/2012 | Shook | 405/100 |
| 2014/0109993 | A1 | | 4/2014 | Kelly | |

FOREIGN PATENT DOCUMENTS

| | | |
|---|---|---|
| EP | 2764192 | 8/2014 |
| GB | 2147933 | 5/1985 |
| JP | 55-085720 | 6/1980 |
| JP | 04-203112 | 7/1992 |

OTHER PUBLICATIONS

Smart Vent, product literature "Smart Vent Foundation Flood Vents vs. Flood Flaps" printed Apr. 6, 2015.

Smart Vent, product literature "Family of Products" printed Apr. 6, 2015.

FEMA, Openings in Foundation Walls and Walls of Enclosures, Technical Bulletin 1, Aug. 2008.

FEMA, Non-Residential Floodproofing, Technical Bulletin 3, Apr. 1993.

Smart Vent, "Foundation Flood Vents" printed Apr. 6, 2015.

Smart Vent, Product Catalog printed Apr. 6, 2015.

* cited by examiner

CONNECTORS FOR A FLOOD VENT

TECHNICAL FIELD

This invention relates generally to flood water control devices and more particularly to connectors for a flood vent.

BACKGROUND

Typically, one or more flood vents may be installed into an opening in a structure (such as a building) in order to provide for equalization of interior and exterior hydrostatic forces caused by flooding fluids, such as water. Such typical flood vents may include a flood vent door that may open to allow flooding fluids to pass into or out of the structure through the flood vent, but that may prevent animals or other pests from entering or exiting the structure through the flood vent. These typical flood vents and/or the typical processes for installing flood vents, however, may be deficient.

SUMMARY

According to one embodiment, a flood vent includes a frame, a door, and at least one connector. The frame forms a fluid passageway through an opening in a structure. Furthermore, the frame extends into the opening in the structure in a first direction. The door is pivotally mounted to the frame in the fluid passageway, and allows a fluid to flow through the fluid passageway. The at least one connector is positioned between an outer perimeter of the frame and an inner perimeter of the opening. Furthermore, each of the at least one connector is configured to apply pressure to the inner perimeter of the opening in a second direction that is at least generally orthogonal to the first direction.

Certain embodiments of the disclosure may provide one or more technical advantages. For example, the flood vent includes at least one connector, where each of the at least one connector is configured to apply pressure to the inner perimeter of the opening in a second direction that is at least generally orthogonal to the first direction. In particular embodiments, the connector may allow for a quicker and/or easier installation of the flood vent because the installation may be performed without special tools and/or without various other time consuming procedures. Furthermore, once the flood vent is inserted (or otherwise installed) in the opening, the connector may be compressed by the frame and an edge of the opening, thereby causing the connector to push outward in the second direction against the edge of the opening in the structure. Such outward pressure applied by the connector (along with friction, in particular embodiments) may at least partially hold (or otherwise secure) the frame within the opening upon the frame being inserted into the opening (as opposed to the frame being inserted into the opening, and then one or more typical installation procedures needing to still be performed before the frame may be held within the opening).

Certain embodiments of the disclosure may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Embodiments of the present disclosure are best understood by referring to FIGS. 1-6 of the drawings, like numerals being used for like and corresponding parts of the various drawings.

Figure 1B:
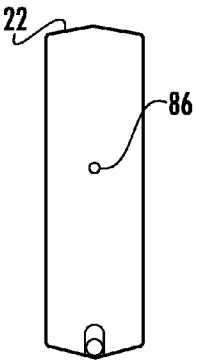
FIG. 1*b* illustrates a side view of the door of FIG. 1*a*.
Figure 2B:
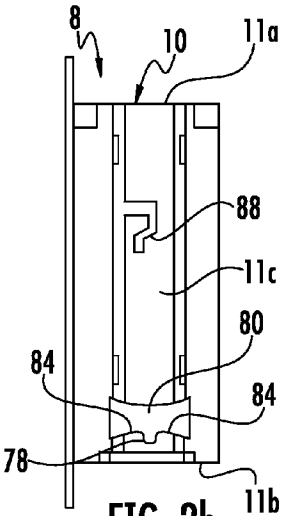
FIG. 2*b* illustrates side view of the frame of FIG. 2*a*.
Figure 1A:
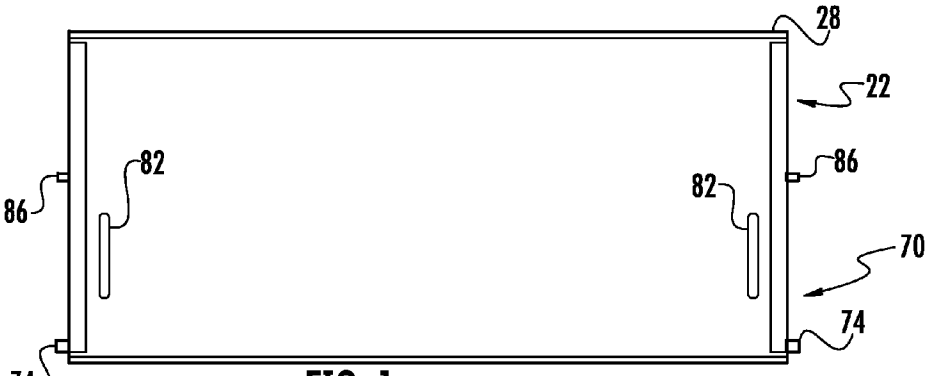
FIG. 1*a* illustrates a front view of a door of an example flood vent.
Figure 2A:
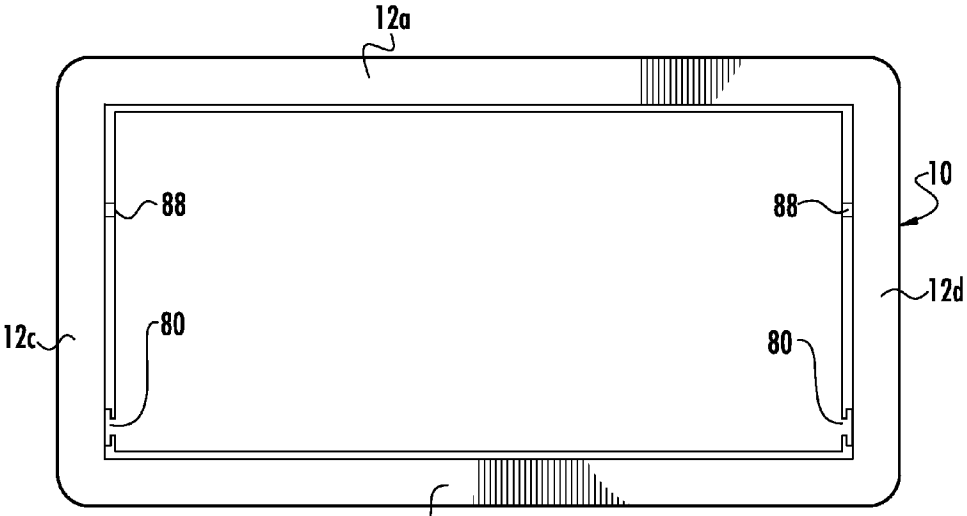
FIG. 2*a* illustrates a front view of a frame of an example flood vent.

FIGS. 1 and 2 illustrate an example of a flood vent 8. The flood vent 8 may be inserted (or otherwise installed) into an opening in a structure (not shown), such as an opening in a building, a wall, a foundation, a basement, a garage, a foyer, an entry, any structure located below base flood plain levels, any other structure, or any combination of the preceding. The flood vent 8 may provide an entry point and/or exit point in the structure for flooding fluids, such as water. As such, the flood vent 8 may provide equalization of interior and exterior hydrostatic forces caused by the flooding fluids. In particular embodiments, the flood vent 8 may comply with various building code and federal governments regulations that mandate that buildings with enclosed spaces located below base flood plain levels, such as crawl spaces, must provide for automatic equalization of interior and exterior hydrostatic forces caused by flooding fluids. According to these regulations, flooding fluids must be permitted to enter and exit the enclosed spaces freely using flood venting.

As illustrated, the flood vent 8 includes a frame 10 and a door 22. The frame 10 may form a fluid passageway through the opening in the structure, thereby allowing the flooding fluids to enter and/or exit the structure. The frame 10 includes a top edge 11*a*, a bottom edge 11*b*, and two side edges 11*c* and 11*d* (not shown). The edges 11 may define an outer perimeter of the frame 10. The frame 10 further includes a top rail 12*a*, a bottom rail 12*b*, and side rails 12*c* and 12*d*. When the flood vent 8 is inserted (or otherwise installed) in the opening in the structure (not shown), the edges 11 of the frame 10 may be positioned (entirely or partially) within the opening of the structure (as is seen in FIG. 3), and the rails 12 may be positioned (entirely or partially) outside the opening of the structure (as is further seen in FIG. 3). Furthermore, although the flood vent 8 is illustrated as including a single frame 10 and a single door 22, the flood vent 8 may include multiple frames 10 and/or multiple doors 10. For example, the flood vent 8 may include two frames 10 (or two or more frames 10) stacked on top of each other (and coupled together), along with one or more doors 22 attached to each frame 10. As another example, the flood vent 8 may include two frames 10 (or two or more frames 10) positioned horizontally next to each other (and coupled together), along with one or more doors 22 attached to each frame 10. As a further example, the flood vent 8 may include two frames 10 (or two or more frames 10) stacked on top of each other and two frames 10 (or two or more frames 10) positioned horizontally next to each other (and these four or more frames 10 may be coupled together), along with one or more doors 22 attached to each frame 10.

The frame 10 may have any shape. For example, the frame 10 may be rectangular-shaped. The frame 10 may also have any dimensions. For example, the top and bottom edges 11*a* and 11*b* may be approximately 16" long, and the side edges 11*c* and 11*d* may be approximately 8" long, thereby forming an 8"×16" rectangular outer perimeter. Furthermore, the top and bottom rails 12*a* and 12*b* may be approximately 17 11/16" long, and the side rails 12*c* and 12*d* may be approximately 9 11/16" long. Furthermore, when two or more frames 10 are coupled together (as is discussed above), the flood vent 8 may have an outer perimeter of, for example, approximately 16"×16", 8"×32", 16"×32", or any other dimensions. Additionally, the frame 10 may be formed of any material. For example, the frame 10 may be formed of a corrosion resistant material, such as stainless steel, spring steel, plastic, a polymer, any other corrosion resistant material, or any combination of the preceding.

The flood vent 8 further includes a door 22 attached to the frame 10 (or multiple doors 22 attached to multiple frames 10). The door 22 may be pivotally mounted to the frame 10, thereby allowing the door 22 to pivot relative to the frame 10. The door 22 may be mounted to the frame 10 in any manner that allows the door 22 to pivot relative to the frame 10. For example, the door 22 may include one or more door pins 86 that extend from the door 22. In such an example, the door pins 86 may be configured to be received within door slots 88 which may be disposed within the frame 10. As shown in FIG. 2*b*, the door slots 88 may be ?-shaped. As another example, the door slots 88 may be T-shaped. Such configurations may allow the door pins 86 to rise in the door slots 88, thereby permitting the door 22 to rise in response to flooding. Furthermore, such configurations may prevent the door 22 from being easily removed during flooding conditions and can deter entry by unauthorized persons or pests.

The door 22 may include solid panels disposed on opposing faces of the door 22, as is illustrated in FIG. 1*a*. The solid panels may prevent (or substantially prevent) air from passing through the door 22, as well as prevent (or substantially prevent) objects, such as small animals from passing through the door 22. Although the door 22 is illustrated as including solid panels, the door 22 may include any other type of panels. For example, the door 22 may include mesh grille panels (not shown) that include openings that may allow air to pass through the door. In such an example, the size of the openings may be sufficiently small to prevent (or substantially prevent) objects such as small animals from passing through the door 22.

As is discussed above, the flood vent 8 may provide an entry point and/or exit point in the structure for flooding fluids, such as water. In order to do so, the flood vent 8 may include a latching mechanism 70 that may release the door 22 (or multiple latching mechanisms 70 that respectively release one of multiple doors 22 of the flood vent 8), thereby allowing the door 22 to open. The latching mechanism 70 may operate by sensing the level or flow of fluids, such as water, passing through the opening in the structure and, at a preset level, may release the door 22. At a time when the level of fluid has decreased sufficiently so that the door 22 hangs substantially perpendicular to the ground, the latching mechanism 70 may be reset, which in turn may return the door 22 to its pre-release position. The latching mechanism 70 may include any type of device (or combination of devices) that may perform the above discussed functions. As an example, the latching mechanism 70 may include one or more floats (not shown) that may be lifted and/or lowered by the height or flow of fluid through fluid openings 82 in the door 22. The pin 74 extending from each float may be adapted to be inserted into an open slot 78 in the frame 10. When the pin 74 is positioned within the open slot 78, the door 22 may be prevented from swinging in either direction. Once the float is lifted by the height or flow of the fluid such that the pin 74 exits the opening of the open slot 78 (or to any other preset level), the pin 74 may no longer be constrained by the open slot 78, and the door 22 may rotate in the direction of the current of the fluid. The frame 10 may also include a channel 80 which may allow the pin 74 to pass through the frame 10 as the door 22 rotates. Furthermore, use of the float, pin 74, and open slot 78 may also act as a resetting mechanism. For example, one or more guides 84 may be disposed on the frame 10. The guides 84 may be used to position the pin 74 in the open slot 78. The guides 84 may be used when the door 22 returns to a substantially perpendicular position, which may occur when the level of fluid is lower than the opening in the open slot 78. The guides 84, which may be disposed on both sides of the open slot 78, may be angled upward to position the pin 74 upward as the door 22 rotates to a substantially perpendicular position. Once the door 22 reaches this position, the pin 74 can be at the level of the opening of the open slot 78, such that when the pin 74 is positioned over the open slot 78, the pin 74 can fall into the open slot 78 thereby resetting the latching mechanism 70. Further details regarding examples of locking mechanism 70 are included in U.S. Pat. No. 6,692,187 entitled "Flood Gate For Door," which is incorporated herein by reference.

Figure 3A:
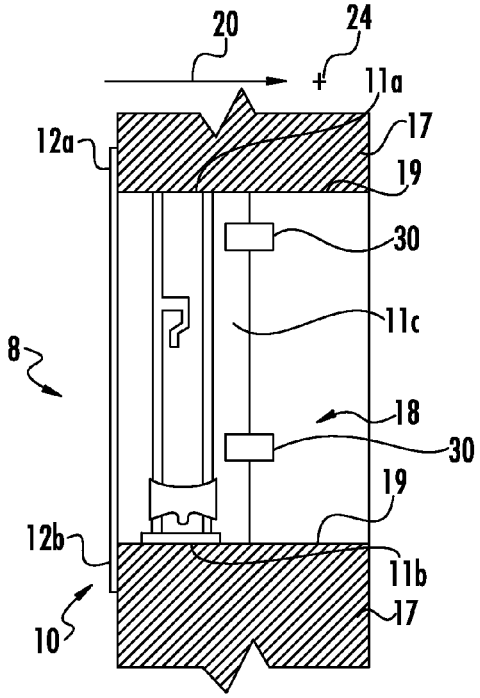
FIG. 3*a* illustrates a side view of the flood vent of FIGS. 1-2 installed in an opening of a structure using example connectors.
Figure 3B:
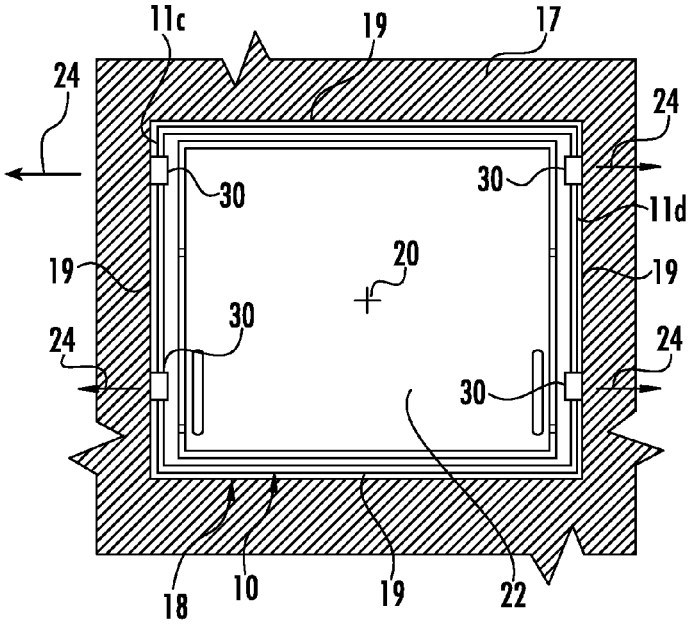
FIG. 3*b* illustrates a back view of the flood vent of FIGS. 1-2 installed in an opening of a structure using example connectors.
Figure 4:
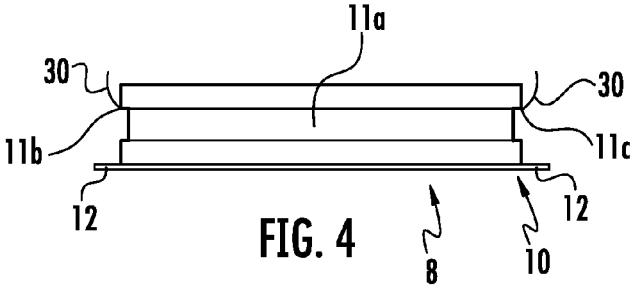
FIG. 4 illustrates a top view of the flood vent of FIGS. 1-2 with example connectors.
Figure 5A:
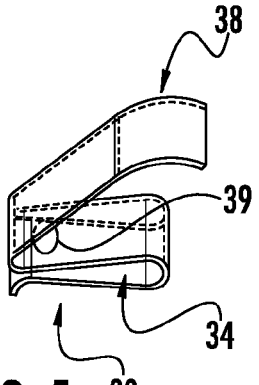
FIGS. 5*a*-5*d* illustrate various views of an example connector of FIGS. 3-4.
Figure 5C:
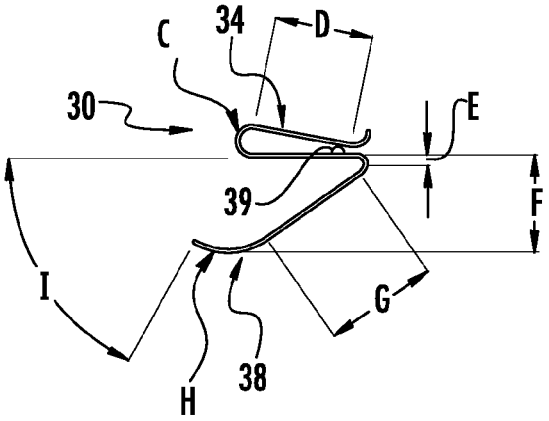
Figure 5B:
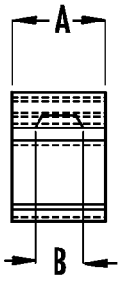
Figure 5D:
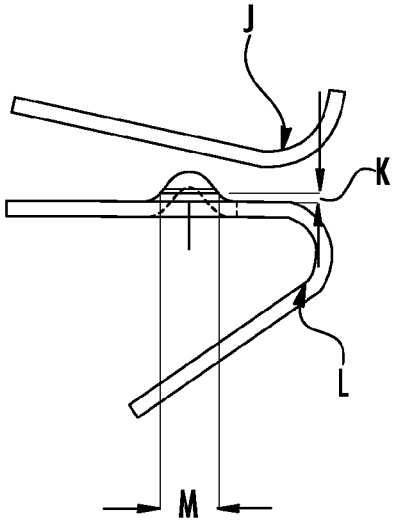

In order to install a flood vent, the flood vent has typically been secured in an opening of a structure using one or more screws, one or more nails, and/or one or more metal straps. Such typical securing means, however, may be deficient. For example, when the flood vent is secured using one or more nails and/or screws, the installer may be required to drill one or more holes in the structure in order to install the flood vent. As such, this typical securing means may require specialized equipment (i.e., a drill) and may further be time consuming. As another example, when the flood vent is secured using one or more metal straps, the installer may be required to install the metal straps on the flood vent (which may be complicated), and also may be required to measure and bend the metal straps to wrap around the back side portion of the structure. As such, this typical securing means may be time consuming. Furthermore, these typical securing means may require significant time consuming procedures even after the flood vent has already been inserted into the opening. For example, in order to install the flood vent using screws, nails, and/or metal straps, the flood vent may need to first be inserted into the opening, and then the screws, nails, and/or metal straps may need to be installed on the flood vent and/or structure before the screws, nails, and/or metal straps can hold the flood vent within the opening. As such, these typical securing means may be deficient. Contrary to such typical securing means, FIGS. 3-6 illustrate examples of a connector that may be used to install a flood vent in an advantageous manner FIGS. 3-4 illustrate an example of the flood vent of FIGS. 1-2 with one or more connectors. The flood vent 8 may be inserted (or otherwise installed) into an opening 18 in a structure 17. The structure 17 may be a building, a wall, a foundation, a basement, a garage, a foyer, an entry, any structure located below base flood plain levels, any other structure, or any combination of the preceding. The structure 17 may include one or more edges 19 that form an inner perimeter of the opening 18 in the structure 17. The opening 18 may have any shape and/or dimensions for receiving the frame 10 (or frames 10) of the flood vent 8. For example, when the frame 10 has a rectangular outer perimeter of 8"×16", the opening 18 may have a rectangular inner perimeter of 8¼"×16¼". As another example, when the flood vent 8 has multiple frames 10 (as is discussed above) and a rectangular outer perimeter of 16"×32", the opening 18 may have a rectangular inner perimeter of 16⅜"×33". As such, the flood vent 8 may be inserted (or otherwise installed) into the opening 18 of the structure 17.

As is discussed above, the frame 10 of the flood vent 8 includes edges 11 (which define the outer perimeter of the frame 10) and rails 12. When the flood vent 8 is inserted into the opening 18 in the structure 17, the edges 11 may extend into the opening 18 of the structure 17 in a first direction 20. As such, the edges 11 of the frame 10 may be positioned (entirely or partially) within the opening 17 of the structure 18. Also, when the flood vent 8 is inserted into the opening 18 in the structure 17, the rails 12 may be positioned (entirely or partially) outside the opening 18 of the structure 17. Thus, the rails 12 may prevent the flood vent 8 from falling through the opening 18 and into the structure 17.

In order to insert (or otherwise install) the flood vent 8 into the opening 18 of the structure 17, the flood vent 8 further includes one or more connectors 30. A connector 30 may include any element configured to at least partially hold (or otherwise secure) the frame 10 within the opening 18 of the structure 17. For example, a connector 30 may be a spring clip, a flat spring, a tooth clip, any other element configured to at least partially hold (or otherwise secure) the frame 10 within the opening 18 of the structure 17, or any combination of the preceding.

Additionally, the connector 30 may be configured to apply pressure to the inner perimeter of the opening 18 of the structure 17 in a second direction 24 which may be orthogonal to first direction 20. For example, the connector 30 may be a spring clip that pushes outward in the second direction 24 against an edge 19 of the structure 17, thereby applying pressure to the inner perimeter of the opening 18. This second direction 24 is illustrated as pointing out of the page in FIG. 3*a*, and illustrated as moving left-to-right (or right-to-left) in FIG. 3*b*. Furthermore, although the second direction 24 has been explained as being orthogonal to the first direction 20, in particular embodiments, the second direction 24 may be at least generally orthogonal to the first direction 20. The second direction 24 may be at least generally orthogonal to the first direction 20 when at least a majority of the pressure applied by the connector 30 is applied orthogonal to the first direction 20 (as opposed to all of the pressure being applied orthogonal to the first direction 20). As another example, the connector 30 may be a tooth clip that pushes outward in the second direction 24 against an edge 19 of the structure 17, thereby applying pressure to the inner perimeter of the opening 18. In such an example, the tooth clip may further include teeth that increase friction at the inner perimeter of the opening 18 as the pressure is applied to the inner perimeter of the opening 18. Furthermore, the connector 30 may be positioned between an outer perimeter of the frame 10 and an inner perimeter of the opening 18. For example, as is illustrated in FIG. 3*b*, the connector 30 may positioned between an edge 11 of the frame 10 and an edge 19 of the opening 18 of the structure 17. As such, when the flood vent 8 is inserted (or otherwise installed) into the opening 18, the connector 30 may be compressed by the frame 10 and the edge 19, thereby causing the connector 30 to push outward in the second direction 24 against the edge 19 of the opening 18 (thus pushing outward against the inner perimeter of the opening 18). Such outward pressure applied by the connector 30 (along with friction, in particular embodiments) may at least partially hold (or otherwise secure) the frame 10 within the opening 18 of the structure 17.

The flood vent 8 may include any number of connectors 30. For example, the flood vent 8 may include one connector 30, two connectors 30, three connectors 30, four connectors 30, six connectors 30, eight connectors 30, or any other number of connectors 30. As illustrated in FIG. 3*b*, the flood vent 8 includes four connectors 30 (with two connectors 30 on each side edge 11*c* and 11*d* of the frame 10). In such an example, the two connectors 30 on side edge 11*c* may apply pressure in one example of second direction 24 (which is illustrated as being directed from right-to-left in FIG. 3*b*), and the two connectors 30 on side edge 11*d* may apply pressure in a different example of second direction 24 (which is illustrated as being directed from left-to-right in FIG. 3*b*).

Furthermore, a connector 30 may be attached to (or formed as a part of) any one of the edges 11 of the frame 10. For example, a connector 30 may be attached to (or formed as a part of) the top edge 11*a*, the bottom edge 11*b*, or either of the side edges 11*c* and 11*d*. As another example, the connector 30 may be attached to (or formed as a part of) two edges 11, such as both top edge 11*a* and side edge 11*c* (e.g., at a position where the top edge 11*a* and the side edge 11*c* join together). In particular embodiments, the edge 11 to which the connector 30 is attached to (or formed as a part of) may change the orientation of second direction 24. As an example, a connector 30 on side edge 11*c* may apply pressure in one example of second direction 24 (which is illustrated as being directed from right-to-left in FIG. 3*b*), a connector 30 on side edge 11*d* may apply pressure in another example of second direction 24 (which is illustrated as being directed from left-to-right in FIG. 3*b*), a connector 30 on top edge 11*a* may apply pressure in another example of second direction 24 (which may be directed from bottom-to-top in FIG. 3*b*), and a connector 30 on bottom edge 11*b* may apply pressure in another example of second direction 24 (which may be directed from top-to-bottom in FIG. 3*b*). In particular embodiments, a connector 30 that is attached to (or otherwise formed as a part of) one or more edges 11 of the frame 10 may be positioned between the edge 11 of the frame 10 and an edge 19 of the opening 18 of the structure 17 when the frame 10 is inserted (or otherwise installed) into the opening 18. Although the connector 30 has been described as being attached to (or formed as a part of) one or more edges 11 of the frame 10, in particular embodiments, the connector 30 may be attached to (or formed as a part of) any other area on frame 10. Additionally, if a flood vent 8 includes multiple frames 10, a connector 30 may be attached to (or formed as a part of) any one or more of the edges 11 of any one or more of the frames 10. For example, a connector 30 may be attached to (or formed as a part of) one or more of the top edge 11*a*, the bottom edge 11*b*, or either of the side edges 11*c* and 11*d* of either of the frames 10 (or any number of the frames 10, including all of the frames 10).

The connector 30 may be configured to be removably coupled to the frame 10. For example, the connector 30 may include a portion that may be attached to a portion of the frame 10, and that also may be removed from the portion of the frame 10. In such an example, the connector 30 may include a clip portion that may clip onto the frame 10 (such as onto one of the edges 11 of the frame 10) and that may also unclip from the frame. Alternatively, the connector 30 may be formed as a portion of the frame 10. For example, the frame 10 may be manufactured with the one or more connectors 30. In such an example, the connectors 30 may be a portion of one or more of the edges 11 of the frame 10. Furthermore, in such an example, the connectors 30 may not be removable from the frame 10 without breaking the connectors 30.

In particular embodiments, contrary to the typical securing means discussed above, the connectors 30 may allow for an easier and/or quicker manner of installation of a flood vent because the installation may be performed without special tools and/or without various other time consuming procedures. For example, the installer may attach one or more connectors 30 to the frame 10 of flood vent 8, and then the installer may insert the frame 10 into the opening 18 of the structure 17. As a result of being inserted into the opening 18 of the structure 17, the connector 30 may be compressed by the frame 10 and an edge 19 of the opening 18 of the structure 17, thereby causing the connector 30 to push outward in the second direction 24 against the edge 19 of the opening 18 (thus pushing outward against the inner perimeter of the opening 18). Such outward pressure applied by the connector 30 (along with friction, in particular embodiments) may at least partially hold (or otherwise secure) the frame 10 within the opening 18 of the structure 17.

Although the frame 10 has been described as being at least partially held (or otherwise secured) within the opening 18 of the structure 17 using connectors 30, in particular embodiments, the frame 10 may be further held (or otherwise secured) within the opening 18 of the structure 17 by an adhesive (such as Lexel® clear adhesive). In such embodiments, the adhesive may be applied to one or more railings 12 of the frame 10. When the frame 10 is inserted into the opening 18 of the structure 17, the railings 12 may be pressed against the structure 17. The connectors 30 may hold (or otherwise secure) the frame 10 within the opening 18 of the structure 17 until the adhesive can set. Furthermore, the connectors 30 may cause the railings 12 to be pressed against the structure 17 until the adhesive can set, without requiring the installer to continuously apply pressure to the railings 12. Once the adhesive is set, the adhesive may further hold (or otherwise secure) the frame 10 within the opening 18 of the structure 17. In particular embodiments, once the adhesive is set, the adhesive may be the primary means of holding (or otherwise securing) the frame 10 within the opening 18 of the structure 17. In such embodiments, the connectors 30 may be a temporary and/or initial means of holding (or otherwise securing) the frame 10 within the opening 18 of the structure 17. Furthermore, in particular embodiments, once the adhesive is set, the connectors 30 may be a back-up means of holding (or otherwise securing) the frame 10 within the opening 18 of the structure, such as, for example, if the adhesive fails.

Furthermore, although the frame 10 has been described as being at least partially held (or otherwise secured) within the opening 18 of the structure 17 using connectors 30, in particular embodiments, the connectors 30 may further allow the frame 10 to be removed from the opening 18 of the structure 17, moved within the opening 18 of the structure 17, and/or readjusted within the opening 18 of the structure 17, even when the connectors 30 are applying pressure to the inner perimeter of the opening 18. For example, as is discussed above, a connector 30 may be configured to apply pressure to the inner perimeter of the opening 18 of the structure 17 in a second direction 24 which may be orthogonal to first direction 20, or at least generally orthogonal to the first direction 20. In particular embodiments, this pressure applied in the second direction 24 may provide a temporary and/or initial means of holding (or otherwise securing) the frame 10 within the opening 18 of the structure 17 until, for example, an adhesive has set. As such, even after the frame 10 has been inserted into the opening 18 of the structure 17 using the connectors 30, the installer may still be able to remove the frame 10 from the opening 18 of the structure 17, move the frame 10 within the opening 18 of the structure 17, and/or readjust the frame 10 within the opening 18 of the structure 17, without requiring special tools or significant effort on the part of the installer. In particular embodiments, this may allow the installer to more easily replace or readjust the frame 10 for various reasons.

FIGS. 5*a*, 5*b*, 5*c*, and 5*d* illustrate an example connector of FIGS. 3-4. As illustrated, the connector 30 is a spring clip. However, as is discussed above, the connector 30 may be any element configured to at least partially hold (or otherwise secure) the frame 10 within the opening 18 of the structure 17. Additionally, the connector 30 may further be any element configured to apply pressure to the inner perimeter of the opening 18 of the structure 17 in a second direction 24 which may be orthogonal (or generally orthogonal) to first direction 20.

The spring clip includes a clip portion 34 and a spring portion 38. The clip portion 34 is configured to removably couple the spring clip to the frame 10. For example, the clip portion 34 may be attached to an edge 11 of the frame 10 by inserting the clip portion 34 onto the edge 11 of the frame 10. Furthermore, the clip portion 34 may be removed from the edge 11 of the frame 10 by detaching the clip portion 34 from the edge 11 of the frame 10, such as by pulling on the clip portion 34, wiggling the clip portion 34 loose, pulling apart the arms of the clip portion 34, or any combination of the preceding. In particular embodiments, the clip portion 34 may apply a compression force on opposing sides of an edge 11 of the frame 10, thereby causing the clip portion 34 to remain attached to the edge 11. Additionally, in particular embodiments, the clip portion 34 may further include an additional manner of attachment. For example, as illustrated, the clip portion 34 may include one or more raised elements 39. The raised element 39 may extend into the area between the arms of the clip portion 34. Furthermore, the raised element 39 may be configured to fit into (or otherwise be received by) a gap (not shown) positioned on the frame 10, such as a gap on an edge 11 of the frame 10. As such, when the clip portion 34 is inserted onto the edge 11 of the frame 10, the raised element 39 of the clip portion 34 may fit into (or otherwise be received by) the gap in the edge 11, thereby further attaching the clip portion 34 to the frame 10. In another embodiment, the frame 10 may include one or more raised elements (similar to raised element 39) and the clip portion 34 may include one or more gaps. As such, when the clip portion 34 is inserted onto the edge 11 of the frame 10, the raised element of the edge 11 of the frame 10 may fit into (or otherwise be received by) the gap in the clip portion 34.

The spring clip further includes the spring portion 38. The spring portion 38 may be configured to apply pressure to the inner perimeter of the opening 18 of the structure 17 in the second direction 24 which may be orthogonal (or generally orthogonal) to first direction 20. For example, as a result of inserting the frame 10 into the opening 18, spring portion 38 may be compressed by the frame 10 and the inner perimeter of the opening 18, thereby causing the spring portion 38 to push outward in the second direction 24 against the inner perimeter of the opening 18 in the structure 17. Such outward pressure applied by the spring portion 38 (along with friction, in particular embodiments) may at least partially hold (or otherwise secure) the frame 10 within the opening 18 of the structure 17.

The spring clip may be formed of any material. For example, the spring clip may be formed of a corrosion resistant material, such as stainless steel, spring steel, plastic, a polymer, any other corrosion resistant material, or any combination of the preceding. The spring clip may have any shape. Furthermore, the spring clip may have any dimensions. For example, the spring clip may have the following dimensions:

A=0.5"±0.005"; 0.75"±0.005"; or 1.00"±0.005"
B=0.25"±0.005"; 0.37"±0.005"; or 0.50"±0.005"
C=radius of 0.07"±0.005"
D=0.51"±0.005"
E=0.171"±0.005"
F=0.5"±0.005"
G=0.59"±0.005"
H=radius of 0.36"±0.005"
I=60°±5°
J=radius of 0.06"±0.005"
K=0.01"±0.005"
L=radius of 0.04"±0.005"
M=0.062"±0.005"

Although the spring clip has been illustrated as including particular dimensions, the spring clip (or any other connector 30) may have any other dimensions.

Figure 6A:
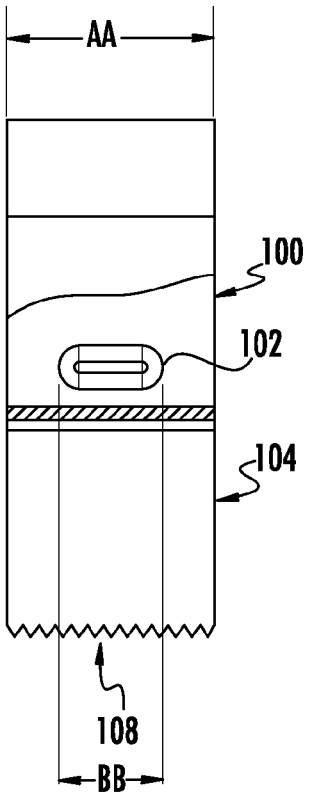
FIGS. 6*a*-6*c* illustrate various views of another example connector of FIGS. 3-4.
Figure 6B:
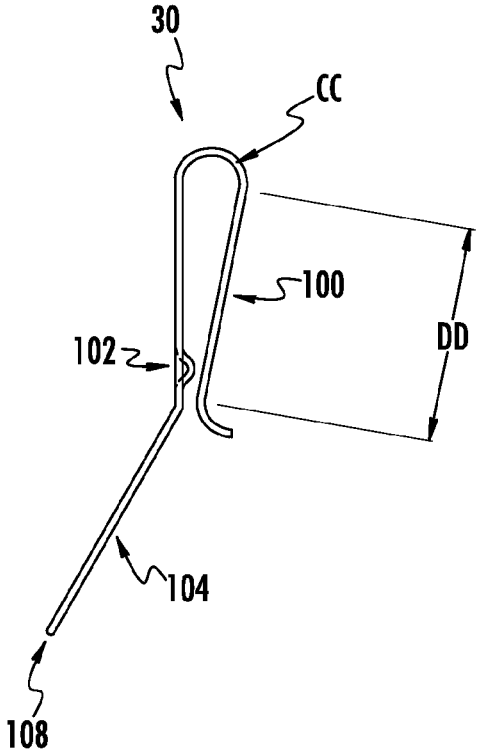
Figure 6C:
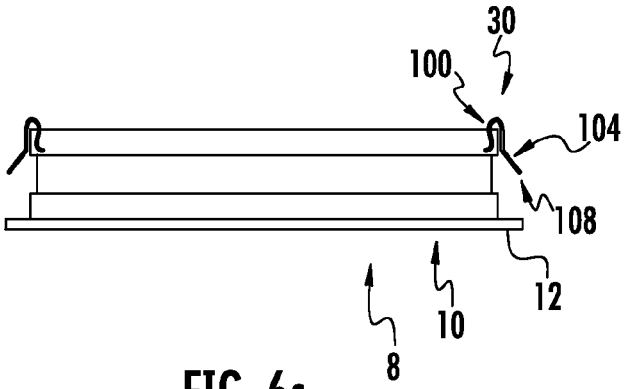

FIGS. 6*a*, 6*b*, and 6*c* illustrate another example connector of FIGS. 3-4. As illustrated, the connector 30 is a tooth clip. The tooth clip includes a clip portion 100, a spring portion 104, and a tooth portion 108. The clip portion 100 is configured to removably couple the tooth clip to the frame 10. For example, the clip portion 100 may be attached to an edge 11 of the frame 10 by inserting the clip portion 100 onto the edge 11 of the frame 10. Furthermore, the clip portion 100 may be removed from the edge 11 of the frame 10 by detaching the clip portion 100 from the edge 11 of the frame 10, such as by pulling on the clip portion 100, wiggling the clip portion 100 loose, pulling apart the arms of the clip portion 100, or any combination of the preceding. In particular embodiments, the clip portion 100 may apply a compression force on opposing sides of an edge 11 of the frame 10, thereby causing the clip portion 100 to remain attached to the edge 11. Additionally, in particular embodiments, the clip portion 100 may further include an additional manner of attachment. For example, as illustrated, the clip portion 100 may include one or more raised elements 102. The raised element 102 may extend into the area between the arms of the clip portion 100. Furthermore, the raised element 102 may be configured to fit into (or otherwise be received by) a gap (not shown) positioned on the frame 10, such as a gap on an edge 11 of the frame 10. As such, when the clip portion 100 is inserted onto the edge 11 of the frame 10, the raised element 102 of the clip portion 100 may fit into (or otherwise be received by) the gap in the edge 11, thereby further attaching the clip portion 100 to the frame 10. In another embodiment, the frame 10 may include one or more raised elements (similar to raised element 102) and the clip portion 100 may include one or more gaps. As such, when the clip portion 100 is inserted onto the edge 11 of the frame 10, the raised element of the edge 11 of the frame 10 may fit into (or otherwise be received by) the gap in the clip portion 100.

The tooth clip further includes the spring portion 104. The spring portion 104 may be configured to apply pressure to the inner perimeter of the opening 18 of the structure 17 in the second direction 24 which may be orthogonal (or generally orthogonal) to first direction 20. For example, as a result of inserting the frame 10 into the opening 18, spring portion 104 may be compressed by the frame 10 and the inner perimeter of the opening 18, thereby causing the spring portion 104 to push outward in the second direction 24 against the inner perimeter of the opening 18 in the structure 17. Such outward pressure applied by the spring portion 104 (along with friction, in particular embodiments) may at least partially hold (or otherwise secure) the frame 10 within the opening 18 of the structure 17.

The tooth clip also includes the tooth portion 108. The tooth portion 108 may be configured to increase friction at the inner perimeter of the opening 18 of the structure 17. For example, as a result of inserting the frame 10 into the opening 18, the spring portion 104 may be compressed by the frame 10 and the inner perimeter of the opening 18, thereby causing the spring portion 104 to push outward in the second direction 24 against the inner perimeter of the opening 18 in the structure 17. By doing so, the tooth portion 108 may be pressed into the inner perimeter of the opening 18 in the structure 17. As such, the tooth portion 108 may dig into (or otherwise grip) the inner perimeter of the opening 10 in the structure 17, increasing friction at the inner perimeter of the opening 18. In particular embodiments, this increased friction at the inner perimeter of the opening 18 may at least partially hold (or otherwise secure) the frame 10 within the opening 18 of the structure 17.

The tooth portion 108 may include any number of teeth. Furthermore, the tooth portion 108 may utilize other gripping appendages other than teeth (or in addition to teeth), such as hooks. The tooth clip may be formed of any material. For example, the tooth clip may be formed of a corrosion resistant material, such as stainless steel, spring steel, plastic, a polymer, any other corrosion resistant material, or any combination of the preceding. The tooth clip may have any shape. Furthermore, the tooth clip may have any dimensions. For example, the spring clip may have the following dimensions:

AA=0.5"±0.005"; 0.75"±0.005"; or 1.00"±0.005"
BB=0.25"±0.005"; 0.37"+0.005"; or 0.50"±0.005"
CC=radius of 0.15"±0.005"
DD=1.1"±0.005"

Although the tooth clip has been illustrated as including particular dimensions, the tooth clip (or any other connector 30) may have any other dimensions.

Modifications, additions, or omissions may be made to the connector 30 (such as the spring clip or tooth clip) without departing from the scope of the invention. For example, the flood vent 8 may further include a hollow metal sleeve that may extend from the frame 10 further into opening 18, such as by extending the entire depth of the opening 18. In such an example, the connector 30 may further be configured to couple the frame 10 to the sleeve, thereby preventing the sleeve from being dislodged from the frame 10.

This specification has been written with reference to various non-limiting and non-exhaustive embodiments. However, it will be recognized by persons having ordinary skill in the art that various substitutions, modifications, or combinations of any of the disclosed embodiments (or portions thereof) may be made within the scope of this specification. Thus, it is contemplated and understood that this specification supports additional embodiments not expressly set forth in this specification. Such embodiments may be obtained, for example, by combining, modifying, or reorganizing any of the disclosed steps, components, elements, features, aspects, characteristics, limitations, and the like, of the various non-limiting and non-exhaustive embodiments described in this specification. In this manner, Applicant reserves the right to amend the claims during prosecution to add features as variously described in this specification, and such amendments comply with the requirements of 35 U.S.C. §§112(a) and 132(a).

The invention claimed is:

1. A flood vent, comprising:

a frame forming a fluid passageway through an opening in a structure, the frame extending into the opening in the structure in a first direction;

a door pivotally mounted to the frame in the fluid passageway for allowing a fluid to flow through the fluid passageway;

at least one connector positioned between an outer perimeter of the frame and an inner perimeter of the opening, each of the at least one connector being configured to apply pressure to the inner perimeter of the opening in a second direction that is at least generally orthogonal to the first direction;

wherein the at least one connector comprises a spring clip; wherein the spring clip comprises:

a clip portion configured to removably couple the spring clip to the frame, the clip portion comprising one or more raised elements configured to fit within one or more gaps; and a spring portion configured to apply the pressure to the inner perimeter of the opening; and wherein the frame comprises the one or more gaps configured to receive the one or more raised elements.

2. The flood vent of claim 1, wherein the second direction is orthogonal to the first direction.

3. The flood vent of claim 1, wherein the pressure is configured to at least partially hold the frame within the opening in the structure.

4. The flood vent of claim 1, wherein the at least one connector comprises two connectors, wherein the first connector is positioned on a first side edge of the frame and the second connector is positioned on a second side edge of the frame, wherein the pressure applied by the first connector is in a different second direction than the pressure applied by the second connector.

5. The flood vent of claim 1, wherein the at least one connector comprises two connectors, wherein the first connector is positioned on a top edge of the frame and the second connector is positioned on a bottom edge of the frame, wherein the pressure applied by the first connector is in a different second direction than the pressure applied by the second connector.

6. The flood vent of claim 1, wherein the at least one connector comprises four connectors, wherein the first and second connectors are positioned on a first side edge of the frame and the third and fourth connectors are positioned on a second side edge of the frame, wherein the pressures applied by the first and second connectors are in a different second direction than the pressures applied by the third and fourth connectors.

7. The flood vent of claim 1, wherein the at least one connector comprises four connectors, wherein the first connector is positioned on a first side edge of the frame, the second connector is positioned on a second side edge of the frame, the third connector is positioned on a top edge of the frame, and the fourth connector is positioned on a bottom edge of the frame, wherein the pressure applied by the first connector is in a different second direction than the pressure applied by each of the second connector, the third connector, and the fourth connector.

8. A method of installing a flood vent, comprising:

pivotally mounting a door to a frame of the flood vent;

attaching at least one connector to the frame;

wherein the at least one connector comprises a spring clip, the spring clip comprising:

a clip portion configured to removably couple the spring clip to the frame, the clip portion comprising one or more raised elements configured to fit within one or more gaps; and a spring portion configured to apply the pressure to the inner perimeter of the opening;

wherein the frame comprises the one or more gaps configured to receive the one or more raised elements; and inserting the frame into an opening in a structure, wherein the frame forms a fluid passageway through the opening in the structure, wherein the frame extends into the opening in the structure in a first direction, wherein the door allows a fluid to flow through the fluid passageway, wherein the at least one connector is positioned between an outer perimeter of the frame and an inner perimeter of the opening, and wherein each of the at least one connector is configured to apply pressure to the inner perimeter of the opening in a second direction that is at least generally orthogonal to the first direction.

9. The method of claim 8, wherein the second direction is orthogonal to the first direction.

10. The method of claim 8, wherein the pressure is configured to at least partially hold the frame within the opening in the structure.

11. The method of claim 8, further comprising:

attaching a first connector of the at least one connector on a first side edge of the frame; and attaching a second connector of the at least one connector on a second side edge of the frame, wherein the pressure applied by the first connector is in a different second direction than the pressure applied by the second connector.

12. The method of claim 8, further comprising:

attaching a first connector of the at least one connector on a top edge of the frame; and attaching a second connector of the at least one connector on a bottom edge of the frame, wherein the pressure applied by the first connector is in a different second direction than the pressure applied by the second connector.

13. A flood vent, comprising:

a frame forming a fluid passageway through an opening in a structure, the frame extending into the opening in the structure in a first direction;

a door pivotally mounted to the frame in the fluid passageway for allowing a fluid to flow through the fluid passageway;

at least one connector positioned between an outer perimeter of the frame and an inner perimeter of the opening, each of the at least one connector being configured to apply pressure to the inner perimeter of the opening in a second direction that is at least generally orthogonal to the first direction;

wherein the at least one connector comprises a spring clip; wherein the spring clip comprises:

a clip portion configured to removably couple the spring clip to the frame, the clip portion comprising one or more gaps configured to receive one or more raised elements; and a spring portion configured to apply the pressure to the inner perimeter of the opening; and wherein the frame comprises the one or more raised elements configured to fit within the one or more gaps.

* * * * *